US010151158B2

(12) United States Patent
Francis et al.

(10) Patent No.: US 10,151,158 B2
(45) Date of Patent: Dec. 11, 2018

(54) BAIL MOUNTED GUIDE

(71) Applicant: Ensco International Incorporated, Wilmington, DE (US)

(72) Inventors: Roberto Antonio Francis, Spanish Fort, AL (US); Bruce John Babin, Katy, TX (US); Tommey William Morin, Houston, TX (US)

(73) Assignee: Ensco International Incorporated, Wilmington, DE (US)

( * ) Notice: Subject to any disclaimer, the term of this patent is extended or adjusted under 35 U.S.C. 154(b) by 444 days.

(21) Appl. No.: 14/923,919

(22) Filed: Oct. 27, 2015

(65) Prior Publication Data

US 2016/0290076 A1 Oct. 6, 2016

Related U.S. Application Data

(60) Provisional application No. 62/142,289, filed on Apr. 2, 2015.

(51) Int. Cl.
*E21B 19/02* (2006.01)
*E21B 19/22* (2006.01)
*E21B 19/24* (2006.01)

(52) U.S. Cl.
CPC ..... *E21B 19/24* (2013.01); *E21B 19/02* (2013.01); *E21B 19/22* (2013.01)

(58) Field of Classification Search
CPC ..... E21B 19/02; E21B 19/22; E21B 19/24
See application file for complete search history.

(56) References Cited

U.S. PATENT DOCUMENTS 4,899,816 A * 2/1990 Mine ..... E21B 19/22 166/385
5,735,351 A * 4/1998 Helms ..... E21B 19/00 166/384
5,803,191 A * 9/1998 Mackintosh ..... E21B 3/02 166/242.5
6,390,190 B2 * 5/2002 Mullins ..... E21B 17/07 166/177.4
6,679,333 B2 * 1/2004 York ..... E21B 19/084 166/379
6,907,934 B2 * 6/2005 Kauffman ..... E21B 19/08 166/379
6,920,931 B1 * 7/2005 Webre ..... E21B 17/026 166/379
9,732,572 B2 * 8/2017 Hickl ..... E21B 21/01
(Continued)

FOREIGN PATENT DOCUMENTS

WO 2005121493 12/2005

OTHER PUBLICATIONS

Application No. PCT/US2016/025577, International Search Report and Written Opinion dated Jul. 1, 2016.

*Primary Examiner* — Matthew R Buck
(74) *Attorney, Agent, or Firm* — Fletcher Yoder, P.C.

(57) ABSTRACT

Techniques and systems to reduce contact of a cable with a top drive. A cable guide may be mounted to one or more bails supporting the top drive and may operate to extend a distance between a cable passing along a length of the top drive. The cable guide may include both an upper guide assembly and a lower guide assembly. Each of the upper guide assembly and the lower guide assembly may both be coupled to one or more bails supporting the top drive in a serial manner.

20 Claims, 7 Drawing Sheets

(56) References Cited

U.S. PATENT DOCUMENTS

| | | | | |
|---|---|---|---|---|
| 2006/0032638 | A1* | 2/2006 | Giroux | E21B 7/20 166/377 |
| 2007/0062705 | A1 | 3/2007 | Schats et al. | |
| 2008/0060818 | A1* | 3/2008 | Bourgeois | E21B 19/087 166/380 |
| 2010/0243324 | A1* | 9/2010 | Veeningen | E21B 17/028 175/40 |
| 2013/0105168 | A1* | 5/2013 | Overland | E21B 19/06 166/352 |

* cited by examiner

BAIL MOUNTED GUIDE

CROSS REFERENCE TO RELATED APPLICATIONS

This application is a Non-Provisional Application of U.S. Provisional Patent Application No. 62/142,289, entitled "Bail Mounted Guide", filed Apr. 2, 2015, which is herein incorporated by reference.

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Top drives may be utilized in modern drilling to provide torque to a drillstring. However, the placement of a top drive above the drill floor may operate as an impediment to operations utilizing cabling down a wellbore and/or passing cabling into the wellbore through the drill floor. For example, a cable to be passed through the drill floor to the wellbore may contact the top drive as it is being sent through the drill floor, possibly damaging the cable and/or the top drive. Thus, while conventional access to drill pipe on rigs equipped with a top drive involves routing the cabling along the top drives to gain access to the wellbore centerline, by routing the cable in this manner, abrasion points may be present that can impact the cable and/or the top drive. Accordingly, it would be desirable to develop techniques and systems that would allow for feeding cabling through a drill floor without the top drive contacting the cabling.

DETAILED DESCRIPTION

Figure 1:
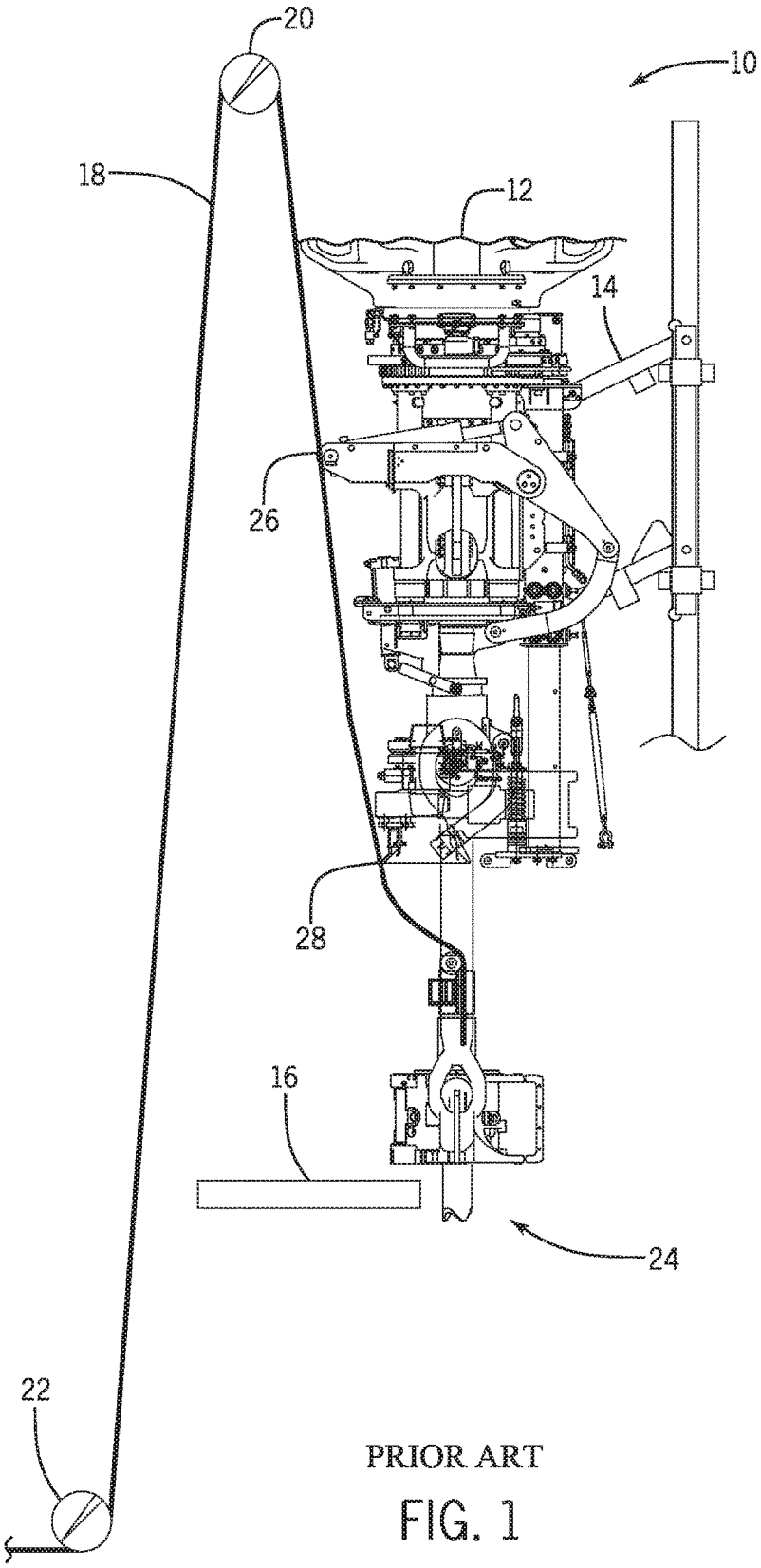
PRIOR ART FIG. 1
FIG. 1 illustrates an example of a drilling system, in accordance with an embodiment.

One or more specific embodiments will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements.

Systems and techniques described herein relate to bail supported guidance of a cable. In some embodiments, one or more cable guide assemblies may be installed and utilized to increase a distance between a cable passing adjacent to a top drive. The assemblies and techniques may be applied, for example, in stripping operations (e.g., putting drillpipe into a wellbore when pressure is contained in a well), workover operations (e.g., repair or stimulation of an existing production well for the purpose of restoring, prolonging or enhancing the production of hydrocarbons), running guns or perforating devices, fishing operations (e.g., the application of tools, equipment, and techniques for the removal of junk, debris, or components from a wellbore), directional drilling (e.g., utilizing side entry sub), and/or open hole logging (e.g., obtaining and/or storing information related to a wellbore) and can be utilized, for example, in conjunction with a slickline, a wireline, and/or another cable.

Additionally, the one or more cable guide assemblies are adjustable to different bails' lengths, separation distances, and diameters. Additionally, the one or more cable guide assemblies are adjustable to heights and angles depending on the lengths of the bails and heights of the derricks. Accordingly, the one or more cable guide assemblies may be utilized in conjunction with a plurality of top drives. Furthermore, the present one or more cable guide assemblies do not introduce sharp angles on the cable (e.g., angles of less than 45 approximately degrees are introduced via each of the one or more cable guide assemblies). In some embodiments, the one or more cable guide assemblies have a rating of at least three times the required cable tension (e.g., greater than 15,000 pounds). Moreover, the one or more cable guide assemblies can be adjusted to fit different configurations of drilling systems for flexibility in application and the one or more cable guide assemblies are cost effective solutions to mitigating issues arising from contact between a cable and a top drive. Accordingly, the one or more cable guide assemblies may pass a cable along at a distance extended from a portion of the top drive above the bail to prevent contact of the wire with the top drive.

With the foregoing in mind, FIG. 1 illustrates an example of a drilling system 10. Although the presently illustrated embodiment of the drilling system 10 may be implemented on a drillship (e.g., a ship equipped with a drill rig and engaged in offshore oil and gas exploration and/or well maintenance or completion work including, but not limited to, casing and tubing installation, subsea tree installations, and well capping), in other embodiments, the drilling system 10 (as well as the components thereof) may be implemented on other offshore platforms, such as a semi-submersible platform, a floating production system, or the like. Similarly, drilling system 10 may be a land based system utilized in onshore oil and gas exploration and/or well maintenance or completion work. Drilling system 10 may include a top drive 12. The top drive 12 may generally be a device that, for example, causes rotation of a drillstring (e.g., a combination of a drillpipe, a bottomhole assembly, and any other tools used to turn a drill bit turn at the bottom of the wellbore). In some embodiments, the drillstring may include one or more motors (e.g., electric or hydraulic) that causes rotation of the drillstring.

The drilling system 10 may also include a retractable top drive dolly 14, which may allow the top drive 12 to extend to a center point of a well and/or or retract away from the center point of a well. The drilling system 10 may be disposed above a drill floor 16 and may further include a cable 18. In some embodiments, the cable 18 may be a wireline that utilizes an electrical cable to lower tools into the wellbore and transmit data. The cable 18 may pass across both an upper sheave 20 and a lower sheave 22, as well as pass along the length of the top drive 12 prior to its entry of a wellbore 24. As the cable 18 passes along the top drive 12, for example, the cable 18 may contact the top drive 12 at points 26 and 28. Interaction between the cable 18 and the top drive 12 at points 26 and 28 may, for example, cause wear on the cable 18 and/or may interfere with the top drive 12. Accordingly, in some embodiments, one or more guides may be implemented to reduce the contact between the cable 18 and, for example, the top drive 12.

Figure 2:
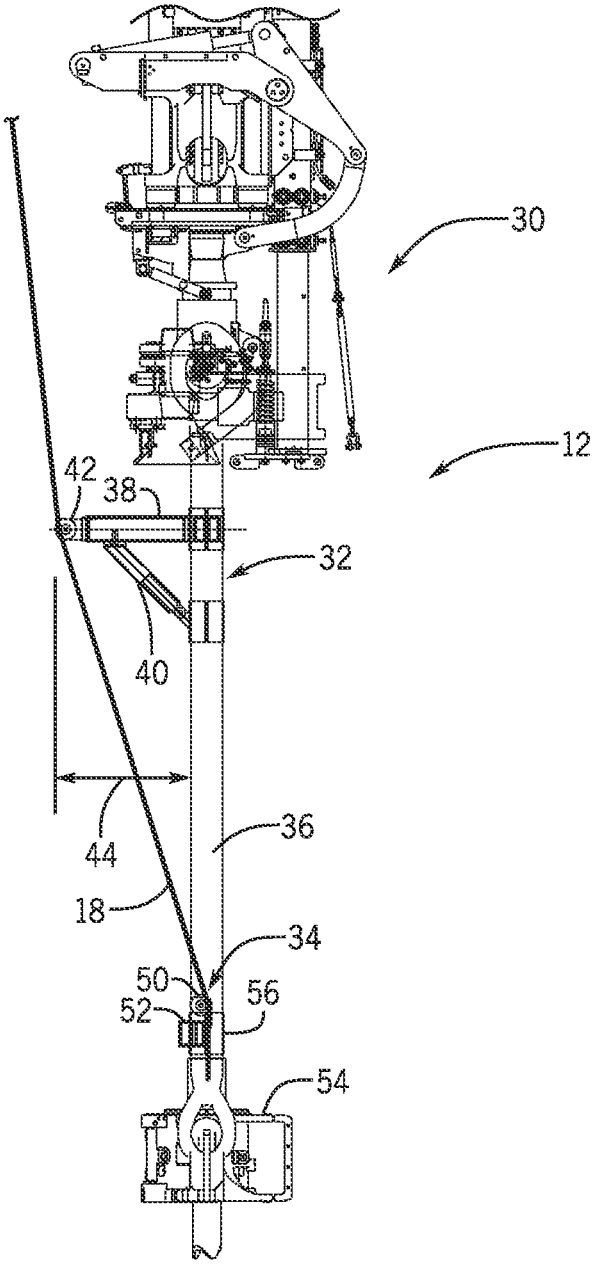
FIG. 2 illustrates an example of a drilling system inclusive of a guide system in a first position, in accordance with an embodiment.

FIG. 2 illustrates a drilling system 30 that includes the top drive 12 and cable 18, similar to the drilling system 10 discussed above. In addition, the drilling system 30 may include one or more cable guide assemblies. In one embodiment, a cable guide assembly may include an upper guide assembly 32 and a lower guide assembly 34. In some embodiments, each of the upper guide assembly 32 and the lower guide assembly 34 may be affixed in series to one or more bails 36 (or elevator links) that may operate to support one or more portions of the top drive 12. In an embodiment, the upper guide assembly 32 and the lower guide assembly 34 may operate in concert to move the cable 18 radially away from the top drive 12. Through the use of the upper guide assembly 32 and the lower guide assembly 34, the cable 18 may be radially separated from top drive 12, which alleviates prospective contact at, for example, points 26 and 28 (FIG. 1).

Figure 3:
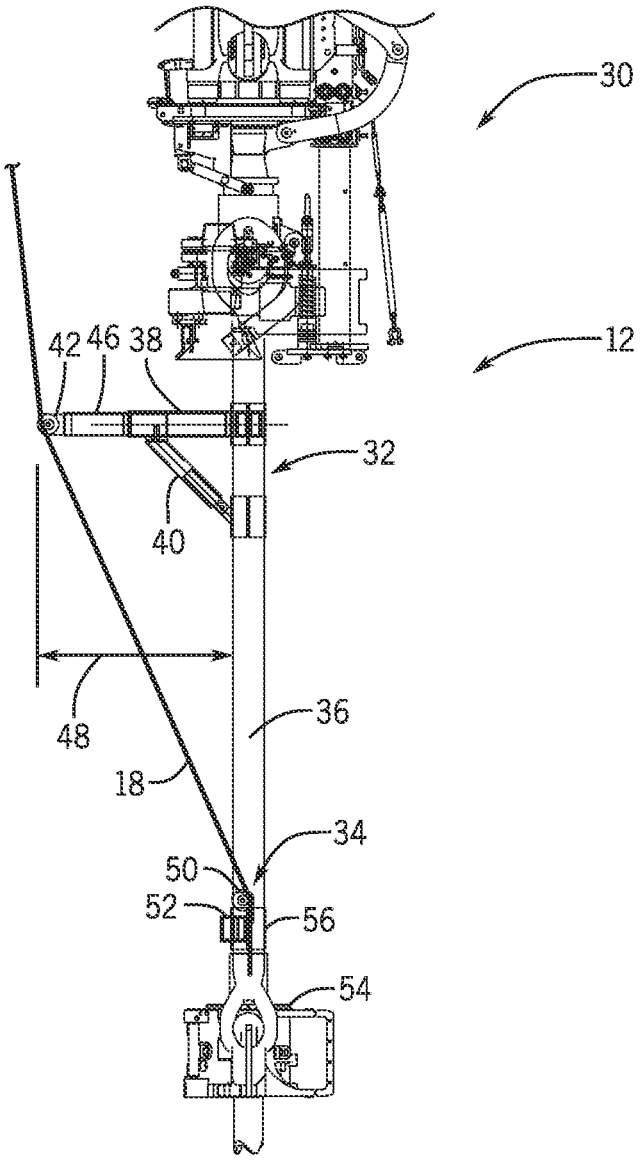
FIG. 3 illustrates an example of a drilling system inclusive of the guide system of FIG. 2 in a second position, in accordance with an embodiment.

As illustrated in FIG. 2, the upper guide assembly 32 may include a lateral mounting assembly 38 that extends, for example, laterally (e.g. perpendicularly at approximately 90 degrees) from the bails 36 as well as one or more support members 40 that extend at an angle (e.g., 30 degrees, 45 degrees, 60 degrees, or another value less than 90 degrees) from the bails 36. In one embodiment, the one or more support members 40 may operate to support the lateral mounting assembly 38. Additionally, the lateral mounting assembly 38 may also include a sheave 42 (e.g., a wheel or roller that may include a groove along its edge for holding the cable 18). The sheave 42 may rotate in response to movement of the cable 18 relative to the sheave. As illustrated in FIG. 3, in some embodiments, the lateral mounting assembly 38 may house a telescopic member 46 that allows the sheave 42 to be extended from a first distance 44 in FIG. 2 to a second distance 48 in FIG. 3 from a distal end of the lateral mounting assembly 38. This may allow for greater clearance from top drive 12 (located, for example, at a center point of the wellbore 24) as the cable 18 passes along sheave 42.

The sheave 42, illustrated in FIGS. 2 and 3, may be made out of a polymer (e.g., polyurethane), steel, or other similar materials. Additionally, the sheave 42 may be coupled to the lateral mounting assembly 38 or to the telescopic member 46. In one embodiment, a pin or other locking mechanism may couple the sheave 42 to the lateral mounting assembly 38 or to the telescopic member 46, while still allowing for rotation of the sheave 42 about the pin. Additionally, in some embodiments, the sheave 42 and/or the pin passing through the sheave 42 may be coupled to the lateral mounting assembly 38 or to the telescopic member 46 via a bearing (e.g., via a pivoting bearing) to allow for vertical and/or horizontal movement (in addition to or in place of rotational motion) of the sheave 42 in response to cable movement 18 and/or to allow for operation when alternate placements of the cable 18 (or upper sheave 20 of FIG. 1) relative to the top drive 12 is encountered.

As additionally illustrated in FIGS. 2 and 3, the cable 18 may pass along sheave 42 to the lower guide assembly 34. The lower guide assembly 34 may include a sheave 50 that is mounted to a mounting assembly 52 of the lower guide assembly 34. In one embodiment, a pin or other locking mechanism may couple the sheave 50 to the mounting assembly 52, while still allowing for rotation of the sheave 50 about the pin. In some embodiments, the lower guide assembly 34 may be disposed above, for example, an elevator 54 and/or adjacent to or disposed above a tool joint 56. Details of both the upper guide assembly 32 and a lower guide assembly 34, respectively, will be described below in conjunction with FIGS. 4-11.

Figure 4:
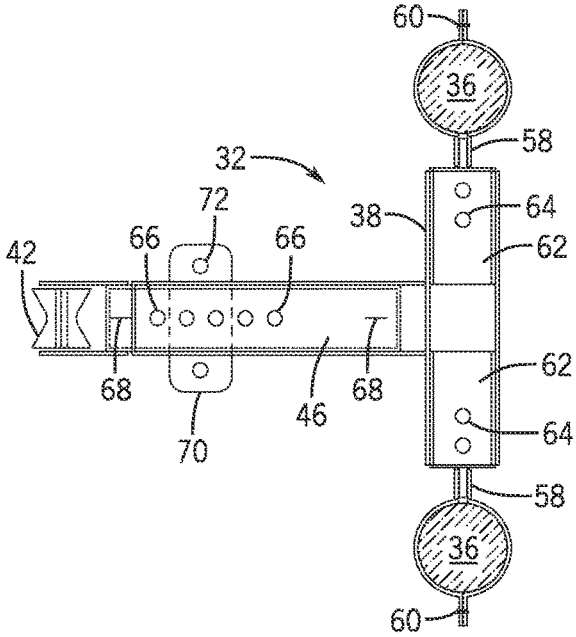
FIG. 4 illustrates a top view of the upper guide assembly of the guide system of FIG. 2, in accordance with an embodiment.

FIG. 4 illustrates a top view of the upper guide assembly 32. As illustrated, the lateral mounting assembly 38 may be a "T" shaped formed member that extends between the bails 36. It is noted that for illustration purposes only, the one or more support members 40 have been omitted from FIG. 4. In some embodiments, the lateral mounting assembly 38 may be coupled to the bails 36 via bail clamps 58 having an adjustable circumferential portion that may adjusted to fit differing diameters of bails 36 and may be tightened by one or more fasteners 60 (e.g., bolts and nuts and the like).

As additionally illustrated in FIG. 4, in some embodiments, the lateral mounting assembly 38 may house one or more telescopic members 62. The one or more telescopic members 62 may extend from proximate ends of the lateral mounting assembly 38 to allow the lateral mounting assembly 38 to fit between different bails 36 (e.g., to allow the lateral mounting assembly 38 to be used with various systems that have bails 36 separated by respective differing distances). In one embodiment, one or more apertures 64 may be disposed in each of the lateral mounting assembly 38 and the one or more telescopic members 62. A locking mechanism (e.g., a pin or other locking mechanism) can be disposed in a respective aperture 64 to lock the lateral mounting assembly 38 to the one or more telescopic members 62 to prevent movement of the one or more telescopic members 62 with respect to the lateral mounting assembly 38.

The lateral mounting assembly 38 of FIG. 4 also includes one or more apertures 66 that may be disposed in each of the lateral mounting assembly 38 and the telescopic member 46. A locking mechanism (e.g., a pin or other locking mechanism) can be disposed in a respective aperture 66 to lock the lateral mounting assembly 38 to the telescopic member 46 to prevent movement of the telescopic member 46 with respect to the lateral mounting assembly 38. Additionally, in some embodiments, one or more lifting eyes 68 may be coupled to the lateral mounting assembly 38 and/or the telescopic member 46 to allow for a connection point for ease of positioning the lateral mounting assembly 38 on the bails 36 via a winch and cable or other lifting mechanism. Additionally, a plate 70 may be coupled to a bottom portion of the lateral mounting assembly 38 to allow for connection to the one or more support members 40. In some embodiments, apertures 72 may be present in the plate 70 such that fasteners may pass through the plate 70 to couple the lateral mounting assembly 38 to the one or more support members 40.

Figure 5:
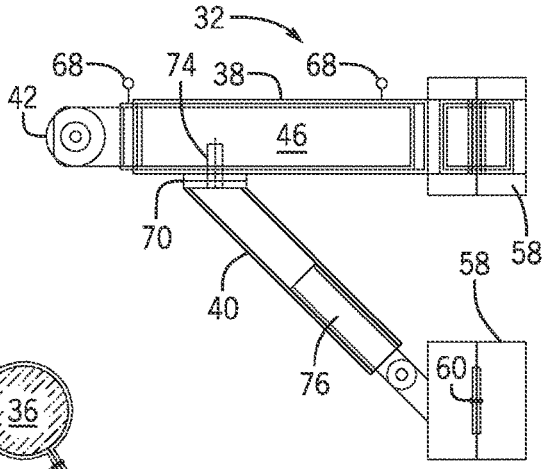
FIG. 5 illustrates a side view of the upper guide assembly of the guide system of FIG. 2, in accordance with an embodiment.
Figure 6:
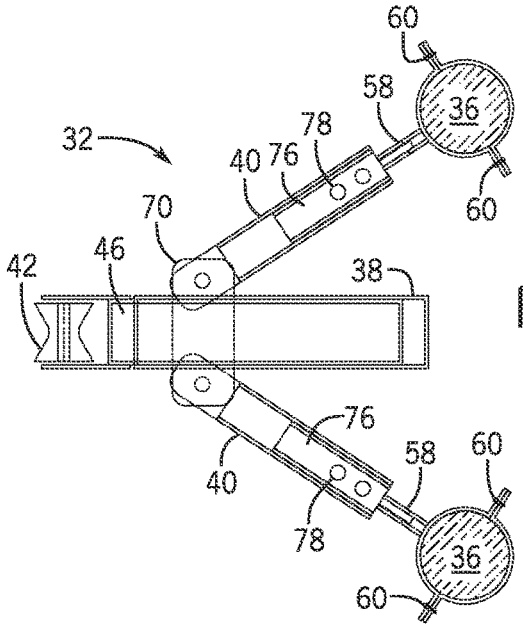
FIG. 6 illustrates a bottom view of the upper guide assembly of the guide system of FIG. 2, in accordance with an embodiment.

FIG. 5 illustrates a side view of the upper guide assembly 32. It is noted that for illustration purposes only, the bails 36 have been omitted from FIG. 5. FIG. 5 illustrates fasteners 74 that may pass through the plate 70 to couple the lateral mounting assembly 38 to the one or more support members 40. Additionally, as illustrated in FIG. 5, the one or more support members 40 may house one or more telescopic members 76. The one or more telescopic members 76 may extend from a distal end of the one or more support members 40 to allow the one or more support members 40 to extend from the bails 36, so as to allow for the upper guide assembly 32 to be used with various top drives 12. Locking of the one or more telescopic members 76 to the one or more support members 40 may be accomplished via a locking mechanism (e.g., a pin or other locking mechanism), that passes through apertures 78 of both the one or more telescopic members 76 and the one or more support members 40, as illustrated in FIG. 6. Thus, FIG. 6, which illustrates a bottom view of the upper guide assembly 32 (not-inclusive of the portion of the lateral mounting assembly 38 between bails 36), shows the manner in which the one or more support members 40 are coupled to the lateral mounting assembly 38 (e.g., via plate 70). However, it is appreciated that alternative versions of the lateral mounting assembly 38 may be implemented.

Figure 7:
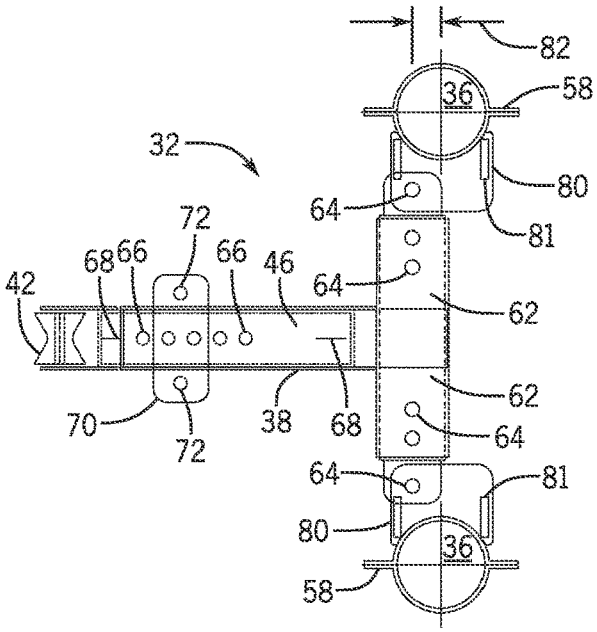
FIG. 7 illustrates a top view of a second embodiment of the upper guide assembly of the guide system of FIG. 2, in accordance with an embodiment.

FIG. 7 illustrates a top view of a second embodiment of the upper guide assembly 32. It is noted that for illustration purposes only, the one or more support members 40 have been omitted from each of FIGS. 7-9. As illustrated, the lateral mounting assembly 38 may be coupled to the bails 36 by an offset bail clamp plate 80 coupled to bail clamps 58. For example, apertures 64 may couple the offset bail clamp plate 80 (via a locking mechanism) to the lateral mounting assembly 38. The offset bail clamp plate 80 may be coupled to a respective bail 36 via a protrusion 81 that may be welded or otherwise affixed to the bail clamp 58. The use of an offset bail clamp plate 80 may allow the lateral mounting assembly 38 to be moved a distance 82 from the bails 36 to allow, for example, directional drilling (that may utilize a side entry sub) to occur without removal of the lateral mounting assembly 38. A second technique to allow for movement of the lateral mounting assembly 38 with respect to the bails 36 is illustrated in FIG. 8.

Figure 8:
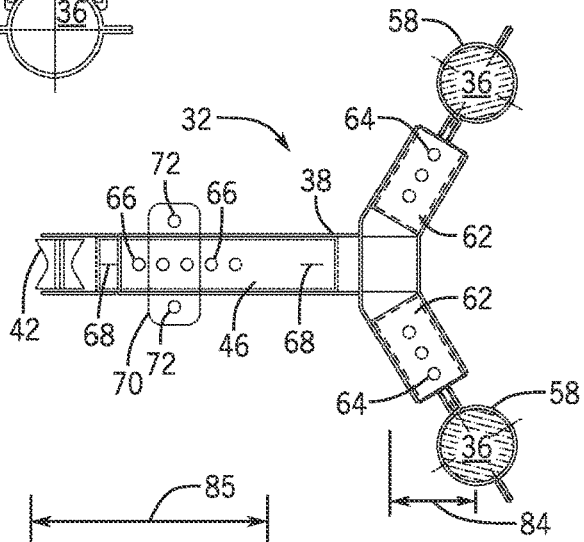
FIG. 8 illustrates a top view of a third embodiment of the upper guide assembly of the guide system of FIG. 2, in accordance with an embodiment.

FIG. 8 illustrates another top view of the upper guide assembly 32. As illustrated, the lateral mounting assembly 38 may be coupled to the bails 36 by one or more telescopic members 62 coupled to bail clamps 58. However, by forming the lateral mounting assembly 38 in a "Y" or a generally "Y" shape (e.g., where legs of the lateral mounting assembly 38 extend horizontally at a predetermined angle greater than 0° relative to a vertical plane of bails 36), the lateral mounting assembly 38 may be positioned a distance 84 from the bails 36. The use of a lateral mounting assembly 38 having the shape illustrated in FIG. 8 may allow the lateral mounting assembly 38 to be moved a distance 84 from the bails 36 to allow, for example, directional drilling (that may utilize a side entry sub) to occur without removal of the lateral mounting assembly 38.

Figure 9:
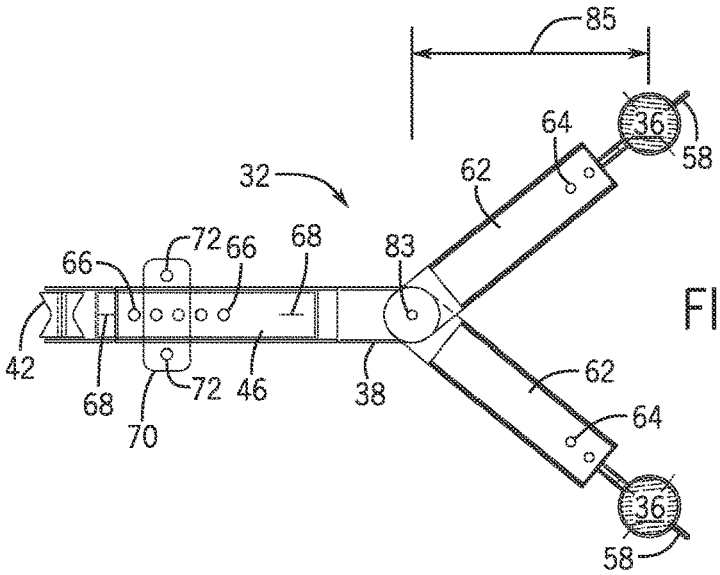
FIG. 9 illustrates a top view of a fourth embodiment of the upper guide assembly of the guide system of FIG. 2, in accordance with an embodiment.

FIG. 9 illustrates an additional top view of the upper guide assembly 32. As illustrated, the lateral mounting assembly 38 may be coupled to the bails 36 by one or more telescopic members 62 coupled to bail clamps 58. Similar to FIG. 8, the lateral mounting assembly 38 may be formed in a "Y" or a generally "Y" shape (e.g., where legs of the lateral mounting assembly 38 extend horizontally at a predetermined angle greater than 0° relative to a vertical plane formed between the bails 36). Additionally, the portions of the lateral mounting assembly 38 that house the one or more telescopic members 62 may be horizontally moveable about a pivot point 83 while being locked vertically by, for example, a fastener. In this manner, the portions of the lateral mounting assembly 38 that house the one or more telescopic members 62 (e.g., legs) may be adjustable about the pivot point 83 (e.g., may be rotatably coupled to a distal portion of the lateral mounting assembly 38) and may allow for greater freedom of movement with respect to the bails 36. For example, this may allow the upper guide assembly 32 to be deployed in environments where the bails 36 are separated by various distances, while still allowing for the lateral mounting assembly 38 to be disposed at a distance 87 from the bails 36.

Figure 10:
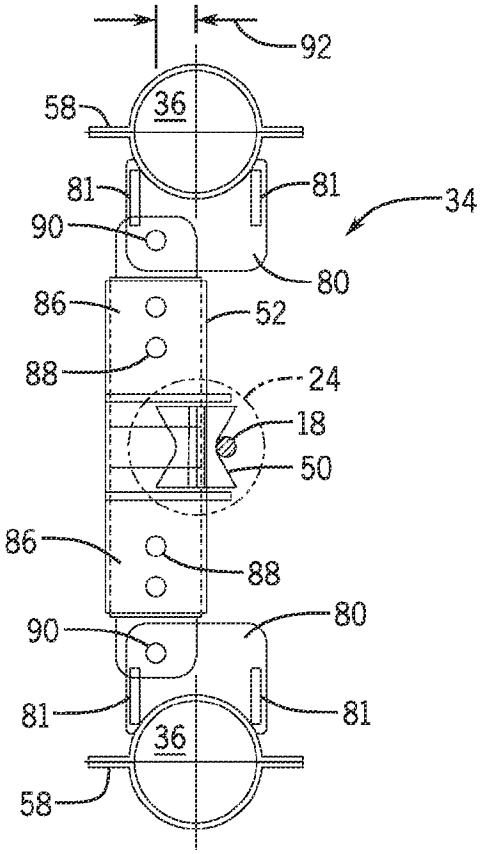
FIG. 10 illustrates a top view of the lower guide assembly of the guide system of FIG. 2, in accordance with an embodiment.

FIG. 10 illustrates a top view of the lower guide assembly 34. The lower guide assembly 34 may include the sheave 50 that is mounted to the mounting assembly 52 of the lower guide assembly 34. Additionally, the mounting assembly 52 may house one or more telescopic members 86. The one or more telescopic members 86 may extend from proximate ends of the mounting assembly 52 to allow the mounting assembly 52 to fit between different bails 36 (e.g., to allow the lateral mounting assembly 38 to be used with various systems that have bails 36 separated by respective distances). In one embodiment, one or more apertures 88 may be disposed in each of the mounting assembly 52 and the one or more telescopic members 86. A locking mechanism (e.g., a pin or other locking mechanism) can be disposed in a respective aperture 88 to lock the mounting assembly 52 to the one or more telescopic members 86 to prevent movement of the one or more telescopic members 86 with respect to the mounting assembly 52.

The mounting assembly 52 of FIG. 10 also includes one or more apertures 90 that may be disposed in each the telescopic members 86 and the offset bail clamp plate 80. In this manner, the mounting assembly 52 may be coupled to the bails 36 by an offset bail clamp plate 80 coupled to bail clamps 58. For example, apertures 90 may couple the offset bail clamp plate 80 (via a locking mechanism) to the mounting assembly 52. The offset bail clamp plate 80 may be coupled to a respective bail 36 via a protrusion 81 that may be welded or otherwise affixed to the bail clamp 58. The use of an offset bail clamp plate 80 may allow the mounting assembly 52 and the sheave 50 to be offset from a center point of the wellbore 24 (e.g., by a distance 92).

Figure 11:
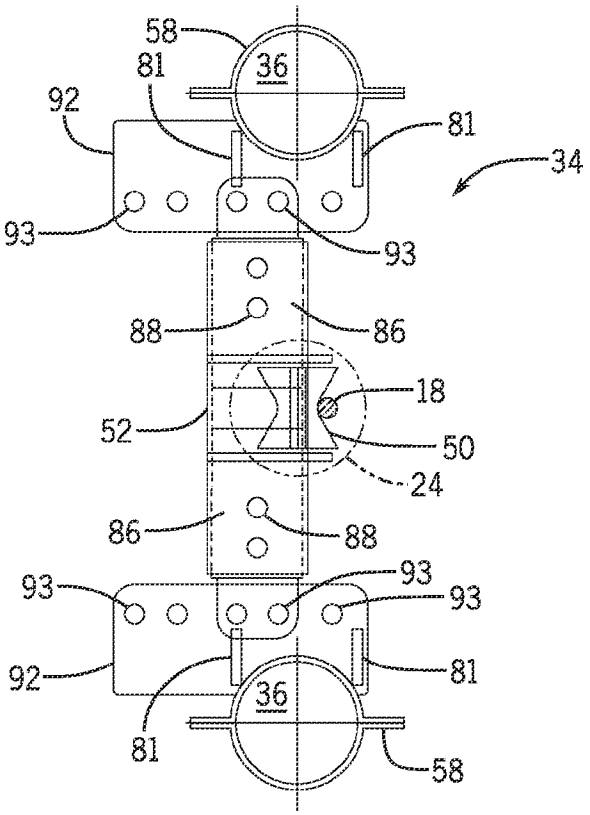
FIG. 11 illustrates a top view of a second embodiment of the lower guide assembly of the guide system of FIG. 2, in accordance with an embodiment.

FIG. 11 illustrates a top view of another embodiment of the lower guide assembly 34. The lower guide assembly 34 is similar to that illustrated in FIG. 10; however, the lower guide assembly of FIG. 11 includes an offset bail clamp plate 92 that differs from the offset bail clamp plate 80 of FIG. 10. The offset bail clamp plate 92 includes additional apertures 93 (also found in the one or more telescopic members 86) that allow for variable connection (via, for example, a locking mechanism) of the one or more telescopic members 86 with the offset bail clamp plate 92. In this manner, the mounting assembly 52 may have greater freedom of movement relative to the center point of the wellbore 24 and can more easily be horizontally moved away from the wellbore 24. Additionally, it should be noted that, in some embodiments, the offset bail clamp plate 92 of FIG. 11 may be used in place of the offset bail clamp plate 80 of the upper guide assembly 32 (FIG. 7) to allow for additional horizontal movement of the lateral mounting assembly 38 relative to the bails 36.

Figure 12:
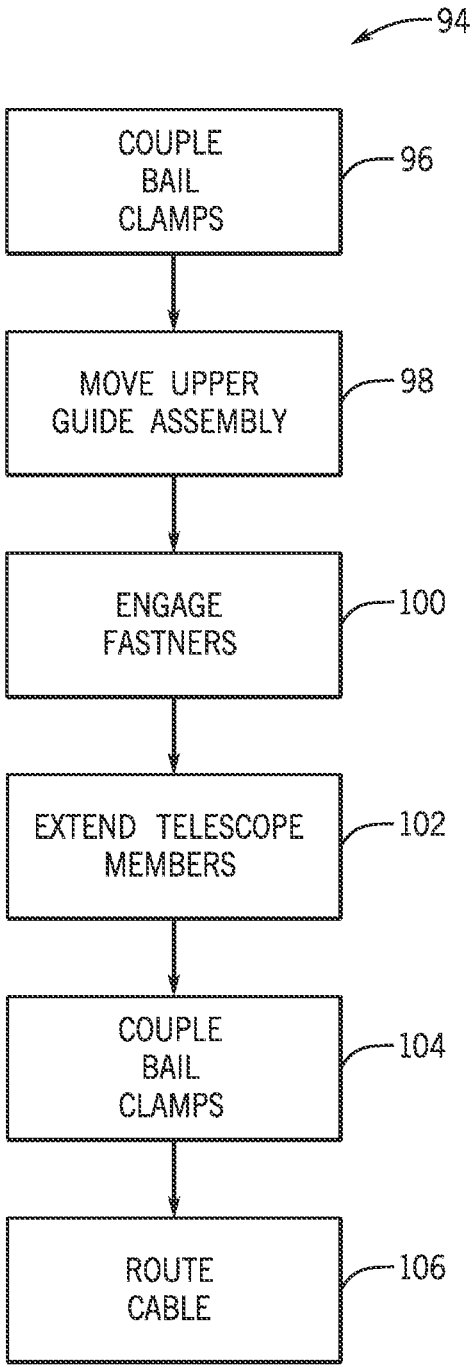
FIG. 12 illustrates a flow chart detailing installation of the guide system of FIG. 2, in accordance with an embodiment.

FIG. 12 illustrates a flow chart 94 representing steps to install each of the upper guide assembly 32 and the lower guide assembly 34. In step 96, the bail clamps 58 may be coupled to the lateral mounting assembly 38 and to the bails 36. During step 96, the one or more fasteners 60 need not be fully engaged (e.g., the one or more fasteners 60 may be only partially engaged or tightened). In step 98, the upper guide assembly 32 may be moved up or down the bails 36 until a desired height is reached and the telescopic member 46 may be positioned to a desired distance from the bails 36. In some embodiments, this may be accomplished utilizing the one or more lifting eyes 68. In step 100, the fasteners 60 (for both the lateral mounting assembly 38 and the support members 40) may be fully engaged (tightened). In step 102, the one or more telescopic members 86 of the lower guide assembly 34 may be extended (as necessary) from the mounting assembly 52 to allow the mounting assembly 52 to fit between the bails 36. In step 104, the bail clamps 58 may be coupled to the bails 36 and the offset bail clamp plate 80 may be coupled to the one or more telescopic members 86 and the relevant fasteners and locking mechanisms may be engaged. In step 106, the cable 18 may be routed across sheave 42 and 50. While the above described steps are set forth in flow chart 94, it is understood that more or less steps than those enumerated may be undertaken to install each of the upper guide assembly 32 and the lower guide assembly 34. The additional steps may correspond to, for example, adjustments to the adjustable portions of the upper guide assembly 32 and/or the lower guide assembly 34.

This written description uses examples to disclose the above description, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims. Accordingly, while the above disclosed embodiments may be susceptible to various modifications and alternative forms, specific embodiments have been shown by way of example in the drawings and have been described in detail herein. However, it should be understood that the embodiments are not intended to be limited to the particular forms disclosed. Rather, the disclosed embodiments are to cover all modifications, equivalents, and alternatives falling within the spirit and scope of the embodiments as defined by the following appended claims.

What is claimed is:

1. A system, comprising:

an upper guide assembly configured to be disposed at a first location on a bail via a first connector, wherein the bail is configured to be coupled to a top drive of a drilling system, wherein the upper guide assembly is configured to pass a cable along the top drive at a distance in a lateral direction from a portion of the top drive; and a lower guide assembly configured to be disposed on the bail via a second connector at a second location beneath the first location on the bail and beneath the upper guide assembly, wherein the lower guide assembly is configured to pass the cable to a wellbore.

2. The system of claim 1, wherein the upper guide assembly comprises a lateral mounting assembly configured to extend along the distance in a direction perpendicular to the bail.

3. The system of claim 2, wherein the lateral mounting assembly houses a telescopic member configured to extend beyond a distal end of the lateral mounting assembly.

4. The system of claim 3, comprising a sheave coupled to the telescopic member, wherein the sheave is configured to contact the cable, wherein the sheave is configured to move vertically, move horizontally, or rotate in response to input movements from the cable.

5. The system of claim 2, wherein the upper guide assembly comprises a support member configured to be coupled to the bail and the lateral mounting assembly.

6. The system of claim 5, wherein the support member houses a telescopic member configured to extend beyond a distal end of the support member.

7. The system of claim 5, wherein the upper guide assembly comprises an adjustable bail clamp comprising an adjustable circumferential portion, wherein the adjustable bail clamp is configured to couple the support member to the bail.

8. The system of claim 2, wherein the lateral mounting assembly is configured to extend between the bail and a second bail configured to be coupled to the top drive.

9. The system of claim 2, wherein the first connector comprises an adjustable bail clamp comprising an adjustable circumferential portion, wherein the adjustable bail clamp is configured to couple the lateral mounting assembly to the bail.

10. The system of claim 2, wherein the lateral mounting assembly comprises a leg configured to extend horizontally at a predetermined angle greater than 0° relative to a vertical plane of the bail.

11. The system of claim 10, wherein the leg is rotatably coupled to a distal portion of the lateral mounting assembly.

12. The system of claim 1, wherein the lower guide assembly comprises a sheave configured to contact the cable, wherein the sheave is configured to rotate in response to input movements from the cable.

13. The system of claim 1, wherein the lower guide assembly comprises a mounting assembly, wherein the mounting assembly houses a telescopic member configured to extend beyond a proximate end of the mounting assembly.

14. The system of claim 13, wherein the lower guide assembly comprises an offset bail clamp plate configured to couple the mounting assembly to a bail clamp as the second connector, wherein the offset bail clamp plate is disposed about the bail at a distance from a center point of the wellbore.

15. A device, comprising:

a guide assembly configured to be disposed on a bail, wherein the bail is configured to be coupled to a top drive of a drilling system, wherein the guide assembly is configured to pass a cable along the top drive at a distance from a portion of the top drive and a center point of a wellbore, wherein the guide assembly comprises a first extendable member configured to couple the guide assembly to a bail connector to dispose the guide assembly on the bail, wherein the guide assembly comprises a second extendable member configured to couple the guide assembly to a sheave configured to contact the cable, wherein the second extendable member is extendable to vary the distance between the cable along the sheave and the center point of the wellbore.

16. The device of claim 15, wherein the bail connector comprises an adjustable circumferential portion.

17. The device of claim 16, comprising a plate configured to couple the bail connector to the first extendable member of the guide assembly to position the guide assembly at the distance from the center point of the wellbore.

18. The device of claim 15, wherein the sheave is configured to move vertically, move horizontally, or rotate in response to input movements from the cable.

19. A method, comprising:

attaching a first bail clamp at a first location on a bail configured to be coupled to a top drive of a drilling system;

attaching the first bail clamp to a first guide assembly configured to extend a first distance in a lateral direction from the top drive;

attaching a second bail clamp at a second location beneath the first location on the bail and beneath the first guide assembly; and attaching the second bail clamp to a second guide assembly configured to extend a second distance from the top drive.

20. The method of claim 19, comprising:

routing a cable across at least one portion of the first guide assembly; and routing the cable across at least one portion of the second guide assembly.

* * * * *